United States Patent [19]

Ball et al.

[11] Patent Number: 4,463,885

[45] Date of Patent: Aug. 7, 1984

[54] SKI CARRIER STRAP

[75] Inventors: Joel E. Ball; Brian R. Ball, both of West Haven, Conn.

[73] Assignee: Nörs A/S of America, Inc., Clinton, Conn.

[21] Appl. No.: 448,433

[22] Filed: Dec. 10, 1982

[51] Int. Cl.[3] ..... A45C 71/00

[52] U.S. Cl. ..... 224/250; 224/257; 224/913; 224/917; 294/157

[58] Field of Search ..... 224/250, 257, 258, 917, 224/913; 294/147, 149, 150, 157; 280/814

[56] References Cited

U.S. PATENT DOCUMENTS

| | | | |
|---|---|---|---|
| 2,118,875 | 5/1938 | Windheim | 224/917 X |
| 2,530,695 | 11/1950 | Helmert | 224/917 X |
| 2,812,123 | 11/1957 | Girton | 224/913 X |
| 3,086,806 | 4/1963 | McAndrew | 294/33 |
| 3,194,462 | 7/1965 | Tupper | 224/45 |
| 3,368,655 | 2/1968 | Purdy | 190/51 |
| 3,595,451 | 7/1971 | Branby | 224/913 X |
| 3,768,711 | 10/1973 | Wilkinson | 224/917 X |
| 3,947,927 | 4/1976 | Rosenthal | 224/917 X |
| 3,960,302 | 6/1976 | Mazzoni, Jr. | 224/257 X |
| 4,015,762 | 4/1977 | Mendillo | 280/11.37 A X |
| 4,114,838 | 9/1978 | Knauf | 294/157 |
| 4,120,437 | 10/1978 | Hara | 280/11.37 A X |

FOREIGN PATENT DOCUMENTS

| | | | |
|---|---|---|---|
| 331720 | 9/1958 | Switzerland | 224/917 |

*Primary Examiner*—Steven M. Pollard

[57] ABSTRACT

A carrier strap for carrying a pair of skis of the type having toe bindings and heel bindings is disclosed comprising an endless loop member of flexible foldable material having a forward portion, a middle portion, and a rearward portion, a fastener at the forward portion to detachably fasten together the endless loop into a smaller loop to encircle the pair of skis in engagement with the forward end of the bindings, a fastener at the rearward portion to detachably fasten together the loop member to form a smaller loop encircling the rearward portion of the skis in engagement with the heel bindings, a plurality of strap segments secured to the loop member to detachably hold a pair of ski poles to the loop member and a handle grip formed by the middle portion of the loop member.

15 Claims, 3 Drawing Figures

SKI CARRIER STRAP

BACKGROUND OF THE INVENTION

This invention relates to a carrier for skis and ski poles and more particularly to a one-piece foldable ski carrier strap for carrying a pair of skis and ski-poles.

The sport of skiing necessarily includes for most people the carrying of ski equipment over long distances, e.g., parking lot to ski lift, to lodge, etc. Because of their size and weight, skis are bulky and awkward to transport and it is desirable to form as compact a bundle as possible for carrying such skis together with ski poles. In addition to carrying the skis and poles in a compact bundle, it is also desirable that the ski carrier be conveniently and safely stowable in a skier's pocket since stowage facilities are usually not available at the ski lifts.

Some of the prior ski carriers required two separate straps, thereby being more prone to loss or misplacement. Also, these prior carriers utilized the poles as handles and thus the skis alone could not easily be carried without the poles. These types of carriers are illustrated in Rosenthal, U.S. Pat. No. 3,947,927, and Hara, U.S. Pat. No. 4,120,437. Other prior ski carriers were inconvenient to assemble and did not provide acceptable provisions for also carrying ski poles but rather actually wrapped the ski poles against the skis, as illustrated in Wilkinson, U.S. Pat. No. 3,768,711, and Mendillo, U.S. Pat. No. 4,015,762. Additionally, some of the prior ski carriers also comprised rigid parts that could possibly cause injury during a fall if stowed in a skier's pocket.

SUMMARY OF THE INVENTION

The ski carrier strap of this invention comprises an endless loop member of flexible, foldable material having a forward portion, a middle portion and a rearward portion. A fastener detachably fastens together the forward portion of the loop member to form a smaller loop adapted to encircle a pair of skis in engagement with the forward end of the toe bindings. Another fastener detachably fastens together the rearward portion of the loop member to form a smaller loop to encircle a pair of skis in engagement with the rearward end of the heel bindings. The middle portion of the loop member provides a handle grip to carry the pair of skis in transport. A number of strap segments each having one end securely connected to the loop member and the other end detachably connected to the loop member by pressure-engageable fastening fabric detachably secure ski poles to the loop member. The method for supporting a pair of skis with the carrier strap comprises the steps of placing the skis atop the loop member so that the forward portion of the loop member is forward of the toe bindings and the rearward portion of the loop member is rearward of the heel bindings, forming a first loop with the forward portion of the loop member to encircle the skis in engagement with the forward end of the toe binding, forming a second loop with the rearward portion of the loop member to encircle the skis in engagement with the rearward end of the heel binding, lifting the middle portion of the loop member as a handle grip causing the forward portion of the loop member to become taut against the forward end of the toe bindings and the rearward portion of the loop member to become taut against the rearward end of the heel bindings, and detachably mounting a pair of ski poles to the loop member.

Accordingly, it is a principal object of the present invention to provide a universal size, one-piece ski carrier strap that is foldable to be carried in a skier's pocket.

A further object of the invention is to provide a ski carrier strap that is primarily comprised of flexible and relatively soft material with only insignificant rigid portions to prevent injury if the skier were to fall on the carrier while it is being carried in a pocket.

A still further object of the invention is to provide a ski carrier strap that is easily, conveniently, and quickly assembled around a pair of skis and which is so operable in all types of skiing weather.

Another object of the invention is to provide a ski carrier strap that is economical to manufacture, durable in use in all types of skiing weather, and presents a pleasing sporty appearance.

DESCRIPTION OF THE PREFERRED EMBODIMENT

Figure 1:
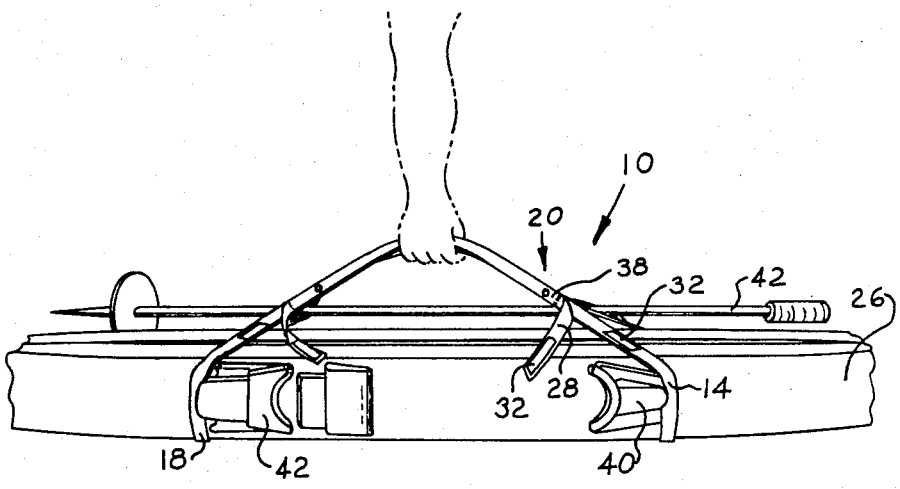
FIG. 1 is a partially broken away perspective view of the ski carrier strap of this invention mounted around a pair of skis and supporting a ski pole.

The ski carrier strap device of this invention is generally designated by the numeral 10 and is shown in FIG. 1 supporting a pair of skis and a ski pole.

Figure 2:
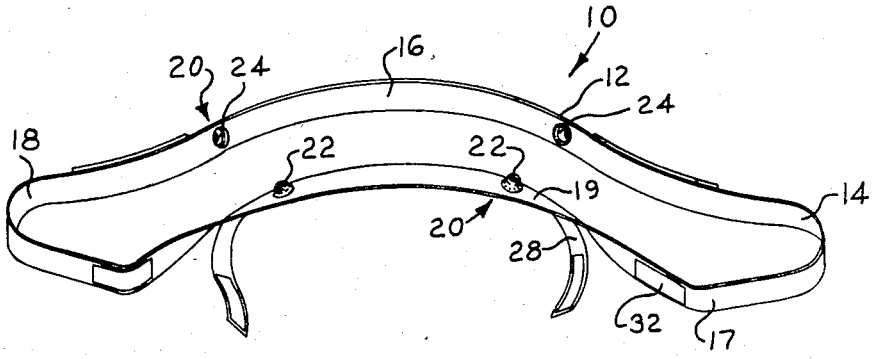
FIG. 2 is a perspective view of the ski carrier strap.

Referring to FIG. 2, carrier strap 10 is comprised of an endless loop member 12 having, for purposes of description, a forward portion 14, a middle portion 16 and a rearward portion 18. A detachable fastener means in the form of a rust resistant button snap 20 having a male button 22 and a female button 24 is located on the inner surface 19 of the forward portion 14 of loop member 12. Button snap 20 fastens to secure loop member 12 together to form a smaller loop to loosely encircle the forward portion of skis 26 as shown in FIG. 1. Similarly, another button snap 20 is located at the rearward portion 18 of loop member 12 to form another smaller loop to loosely encircle the rearward end of skis 26 as shown in FIG. 1. Other types of acceptable fastener means may be utilized although the button type snap is preferable because of its resistance to rust, operability in all weather conditions, and, although rigid in construction, it is of a very small size to be safely carried in a skier's pocket.

Figure 3:
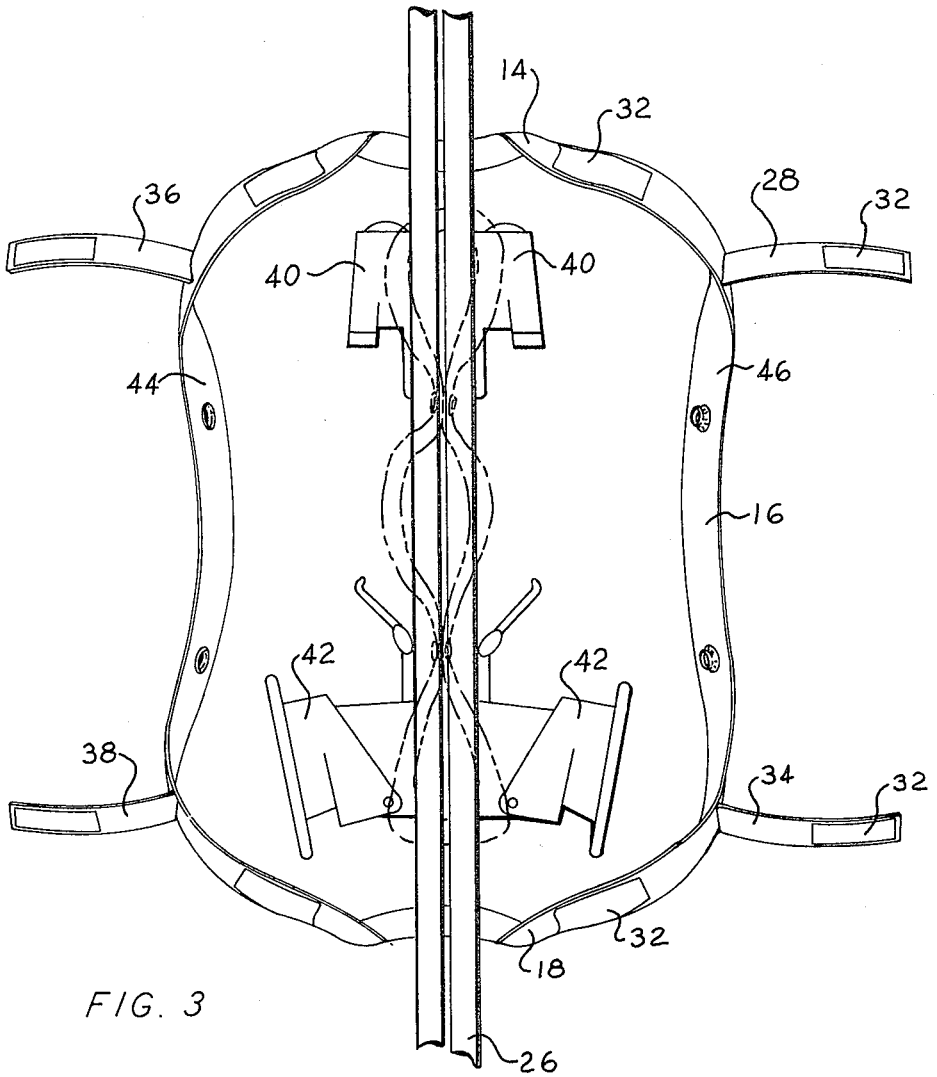
FIG. 3 is a top view of the ski carrier strap and a pair of skis prior to mounting with the ski carrier strap also shown in phantom line in an assembled carrying position.

As shown in FIG. 1, strap segment 28 is securely connected at one end by stitching 30 or the like to loop member 12. The other end of strap segment 28 is detachably fastened to loop member 12 by cooperating pads 32 of pressure-engageable fastening fabric such as that sold commercially under the trademark "VELCRO" by Velcro Corp., New York, N.Y., located on the other end of strap segment 28 and the outer surface 17 of loop member 12. Other acceptable fastening means may be utilized although the fastening fabric is preferable because of its adjustability, easy operability, and safety. Referring to FIG. 3, it can be seen that the detachable end of strap segment 28 extends forwardly relative to loop member 12. Similarly mounted on the same side of loop member 12 is a cooperating strap segment 34 with its detachable end extending rearwardly. As will be explained in more detail subsequently, strap segments 28 and 34 coact to detachably mount a ski pole against loop member 12 during use. Similarly, cooperating strap segments 36 and 38 are likewise attached to the other side of loop member 12 to hold another ski pole.

Endless loop member 12 and strap segments 28, 34, 36, 38 are preferably made of synthetic material such as polypropelene because of foldability for stowage in a pocket, strength, durability and pleasing appearance. Affixation of one end of the strap segments to the loop member by stitching results in a one-piece integrally constructed carrier strap.

In using carrier strap 10, the strap is placed on the ground in an open, single loop configuration (i.e. with button snaps 20 disengaged) with a pair of back-to-back skis placed atop loop member 12 as shown in FIG. 3. Forward portion 14 of loop member 12 is located forward of toe bindings 40 and rearward portion 18 is located rearward of heel bindings 42. The opposite sides of loop member 12 identified for purposes of description as sides 44 and 46 in FIG. 3 are drawn upwardly around skis 26 and fastened together to form a smaller loop loosely encircling the pair of skis 26 forward of toe bindings 40. Button snaps 20 are engaged to detachably secure forward portion 14 in the configuration of the smaller loop. Likewise, the rearward portion 18 of loop member 12 is drawn up around the pair of skis 26 to form a smaller looop loosely encircling the skis 26 rearward of heel bindings 42. Button snap 20 secures rearward portion 18 in the configuration of the smaller loop.

Still referring to FIG. 3, endless loop member 12 has thus been formed into a series of three smaller loops composed of forward portion 14, middle portion 16, and rearward portion 18 as shown in phantom line. As best seen in FIG. 1, forward portion 14 laterally engages the forward end of toe binding 40 while rearward portion 18 laterally engages the rearward end of heel binding 42. Middle portion 14 forms a handle grip such that lifting the skis with the carrier strap causes the strap to become taut against the forward end of the toe bindings and the rearward end of the heel bindings. Thus, although the carrier strap loosely encircles the pair of skis 26, the taut engagement of the strap with the bindings together with the encircling support of the skis provides a secure, stable carrying configuration that prevents the skis from sliding longitudinally. Importantly, this carrier strap universally fits all sizes of skis without any adjustment or modifications to the carrier strap.

After the opposite sides of the loop member 12 are fastened around the skis, a ski pole 48 is secured between strap segment 36 and loop member 12 and between strap segment 38 and loop member 12, as illustrated in FIG. 1. The pressure engageable fastener pads 32 allow adjustability to tightly hold ski pole 48 against the carrier strap. Likewise, a second ski pole (not shown) is securable to the carrier strap by strap segments 28 and 34 to hold it in a generally parallel disposition to ski pole 48. Thus, the pair of skis and poles can easily be carried by lifting the middle portion 16 of loop member 12 as shown in FIG. 1.

Upon arriving at the skiing destination, the poles are quickly removed by separating the pressure engageable pads 32 to release the poles. Button snaps 20 are disengaged to allow skis 26 to be removed from the carrier strap 10. Carrier strap 10 is then foldable into a compact configuration easily insertable into one's pocket without inconvenience or discomfort. Since the strap is of one piece construction, there are no additional pieces to be lost or misplaced. Since the strap is primarily comprised of soft pliable material, falling on the folded up strap in one's pocket will not cause injury.

The carrier strap together with button snaps 20 and pressure engageable fasteners 32 are easily operable in all types of weather conditions to provide an easy, quick, and conveniently assembled ski carrier strap. Such a carrier strap is particularly economical to manufacture being comprised of readily available materials that are easily assembled and provide a refined appearance. Thus it can be seen that this device accomplishes at least all of its stated objectives.

What is claimed is:

1. A carrier strap for carrying a pair of skis of the type having toe bindings and heel bindings, comprising:

an endless loop member of flexible foldable material having a forward portion, a middle portion and a rearward portion, comprising opposing right and left side segments extending forwardly and rearwardly;

a forward fastener means for detachably fastening said right side segment to said left side segment at said forward portion of said loop member to form a smaller forward loop, of sufficient size to encircle a pair of skis in engagement with the forward end of the toe bindings;

a rearward fastener means for detachably fastening said right side segment to said left side segment at said rearward portion of said loop member to form a smaller rearward loop, of sufficient size to encircle a pair of skis in engagement with the rearward end of the heel bindings; and said right side segment and said left side segment of said middle portion of said loop member between said forward and rearward fastener means coacting to form a dual segment handle grip to carry the pair of skis when said forward loop encircles the skis in engagement with the forward end of the toe bindings and said rearward loop encircles the skis in engagement with the rearward end of the heel bindings.

2. The carrier of claim 1 wherein said forward fastener means comprises a first button snap assembly with a male button mounted on one side of said loop member and a female button mounted on the opposing side of said loop member, and said rearward fastener means comprises a second button snap assembly with a male button mounted on one side of said loop member and a female button mounted on the opposing side of said loop member.

3. The carrier of claim 1 wherein said forward fastener means is positioned on said loop member to form said forward loop in a sufficient size to loosely encircle the pair of skis and said rearward fastener means is positioned on said loop member to form said rearward loop in a sufficient size to loosely encircle the pair of skis.

4. The carrier of claim 3 wherein said forward loop is taut and laterally engages the forward end of the toe bindings and said rearward loop is taut and laterally engages the rearward end of the heel bindings when said handle grip is lifted to carry a pair of skis assembled in the carrier strap.

5. The carrier of claim 1 further comprising means for detachably supporting two ski poles to said loop member, said supporting means being securely connected to said loop member.

6. The carrier of claim 5 wherein said supporting means is integrally constructed with said loop member.

7. The carrier of claim 1 further comprising a first strap segment mounted adjacent said forward loop having first and second ends, said first end being securely connected to one side of said loop member and said second end being detachably fastened to said one side of said loop member, a second strap segment mounted adjacent said forward loop and having first and second ends, said first end being securely connected to the other side of said loop member and said second end being detachably fastened to said other side of said loop member, a third strap segment mounted adjacent said rearward loop and having first and second ends, said first end being securely connected to one side of said loop member and said second end being detachably fastened to said one side of said loop member, and a fourth strap segment mounted adjacent said rearward loop and having first and second ends, said first end being securely connected to the other side of said loop member and said second end being detachably fastened to said other side of said loop member, said first and third strap segments being adapted to support a first ski pole between said strap segments and said loop member, said second and fourth strap segments being adapted to support a second ski pole between said strap segments and said loop member.

8. The carrier of claim 7 wherein said second ends of said respective strap segments are detachably fastened to said loop member by pressure-engagable fastening fabric pads on said strap segments and said loop member.

9. In combination, a pair of skis adjoining back-to-back with each having toe bindings and heel bindings and a carrier strap supporting said skis in a hand-holdable transport position, said strap comprising an endless loop member of flexible foldable material having a forward portion, a middle portion, and a rearward portion, comprising opposing right and left side segments extending forwardly and rearwardly, said forward portion being configured to form a forward loop encircling said skis in engagement with the forward end of said toe bindings, a forward fastener means for detechably fastening said right side segment to said left side segment at said forward portion of said loop member, said rearward portion being configured to form a rearward loop encircling said skis in engagement with the rearward end of said heel bindings, a rearward fastener means for detachably fastening said right side segment to said left side segment at said rearward portion of said loop member, and said right right side segment and said left side segment of said middle portion coacting to form a duel segment handle grip for lifting said strap and skis wherein said forward portion laterally engages said toe bindings in a taut condition and said rearward portion laterally engages said heel bindings in a taut condition.

10. The combination of claim 9 wherein the carrier further comprising means for detachably supporting two ski poles to said loop member, said supporting means being securely connected to said loop member.

11. The combination of claim 10 wherein said supporting means is integrally constructed with said loop member.

12. The combination of claim 9 further comprising a first strap segment mounted adjacent said forward loop having first and second ends, said first end being securely connected to one side of said loop member and said second end being detachably fastened to said one side of said loop member, a second strap segment mounted adjacent said forward loop and having first and second ends, said first end being securely connected to the other side of said loop member and said second end being detachably fastened to said other side of said loop member, a third strap segment mounted adjacent said rearward loop and having first and second ends, said first end being securely connected to one side of said loop member and said second end being detachably fastened to said one side of said loop member, and a fourth strap segment mounted adjacent said rearward loop and having first and second ends, said first end being securely connected to the other side of said loop member and said second end being detachably fastened to said other side of said loop member, said first and third strap segments being adapted to support a first ski pole between said strap segments and said loop member, said second and fourth strap segments being adapted to support a second ski pole between said strap segments and said loop member.

13. The combination of claim 12 wherein said second ends of said respective strap segments are detachably fastened to said loop member by pressure-engageable fastening fabric on said strap segments and said loop member.

14. A method for supporting a pair of skis with toe and heel bindings for transporting, comprising the steps of:

providing an endless loop member of flexible foldable material having a forward portion, a middle portion, and a rearward portion, wherein the endless loop member has a forward fastener means to detachably fasten together the forward portion of the loop member and a rearward fastener means to detachably fasten together the rearward portion of the loop member;

arranging the loop member in an open configuration adjacent the skis so that the forward portion of said loop member is forward of the toe bindings and the rearward portion of the loop member is rearward of the heel bindings;

forming a first loop with the forward portion of the loop member to encircle the skis in engagement with the forward end of the toe bindings and fastening one side of the forward portion of the loop member to the other side of the forward portion of the loop member and a second loop with the rearward portion of the loop member to encircle the skis in engagement with the rearward end of the heel bindings and fastening one side of the rearward portion of the loop member to the other side of the rearward portion of the loop member; and lifting the middle portion of the loop member as a handle grip causing the forward portion of the loop member to become taut against the forward end of the toe bindings and the rearward portion of the loop member to become taut against the rearward end of the heel bindings.

15. The method of claim 14 also including the supporting a pair of ski poles for transport, comprising the steps of:

providing means for detachably supporting a pair of ski poles on the loop member; and attaching a pair of ski poles to the supporting means.

* * * * *